US012601031B2

(12) United States Patent
Liu et al.

(10) Patent No.: US 12,601,031 B2
(45) Date of Patent: Apr. 14, 2026

(54) DEVICE AND METHOD OF REGULATING MELTING SPEED OF ALUMINUM ALLOY SMELTING FURNACE BURNER

(71) Applicant: HANGZHOU CITY UNIVERSITY, Hangzhou (CN)

(72) Inventors: Weipeng Liu, Hangzhou (CN); Tao Peng, Hangzhou (CN); Luoke Hu, Hangzhou (CN); Jun Wu, Hangzhou (CN); Xuxia Zhang, Hangzhou (CN); Anping Wan, Hangzhou (CN); Ting Chen, Hangzhou (CN)

(73) Assignee: HANGZHOU CITY UNIVERSITY, Hangzhou (CN)

( * ) Notice: Subject to any disclaimer, the term of this patent is extended or adjusted under 35 U.S.C. 154(b) by 0 days.

(21) Appl. No.: 18/757,564

(22) Filed: Jun. 28, 2024

(65) Prior Publication Data

US 2025/0075288 A1 Mar. 6, 2025

(30) Foreign Application Priority Data

Aug. 28, 2023 (CN) ..... 202311089249.X

(51) Int. Cl.
*C22B 21/00* (2006.01)
*C22C 1/02* (2006.01)

(52) U.S. Cl.
CPC ..... *C22B 21/0084* (2013.01); *C22C 1/026* (2013.01)

(58) Field of Classification Search
None
See application file for complete search history.

(56) References Cited

U.S. PATENT DOCUMENTS 2,768,075 A * 10/1956 Sterental ..... C22B 21/062 266/120
2010/0116453 A1* 5/2010 Grassi ..... F27D 3/145 164/63
2019/0264914 A1* 8/2019 Tsutsumi ..... F27D 7/02

FOREIGN PATENT DOCUMENTS

CA 1123611 A 5/1982
CN 105783508 A 7/2016

OTHER PUBLICATIONS

Notification to Grant Patent Right for Invention, Chinese Application No. 202311089249.X, mailed U.S. Appl. No. 09/052,024 (3 pages).

(Continued)

*Primary Examiner* — Keith D. Hendricks
*Assistant Examiner* — Nikolas Takuya Pullen

(57) ABSTRACT

A device of regulating a melting speed of an aluminum alloy smelting furnace burner. The device includes: a natural-gas flow-rate regulating assembly, an air flow regulating assembly; a natural gas burner, connected to the natural-gas flow-rate regulating assembly and the air flow regulating assembly and mounted in a melting zone of the melting furnace to melt aluminum alloy into an aluminum liquid; a scum filtration assembly, including a ceramic tube connected to a ceramic filter cylinder, a foam ceramic filter plate being merged in an aluminum liquid thermal-insulation pool; a rangefinder, mounted above the scum filter assembly; a controller for obtaining weights of the aluminum liquid corresponding to two adjacent time points, obtaining the actual melting speed according to a difference in the weights, and regulating the flow rate of the natural gas and the air flow to adjust the actual melting speed to reach a target melting speed.

5 Claims, 7 Drawing Sheets

(56) References Cited

OTHER PUBLICATIONS

CNIPA, Office Action issued for Chinese Application No. 202311089249.X, mailed Aug. 23, 2024 (8 pages).

* cited by examiner

DEVICE AND METHOD OF REGULATING MELTING SPEED OF ALUMINUM ALLOY SMELTING FURNACE BURNER

CROSS REFERENCE TO RELATED APPLICATIONS

The present application claims the priority of Chinese patent application No. 202311089249.X, filed on Aug. 28, 2023, contents of which are incorporated herein by its entireties.

TECHNICAL FIELD

The present disclosure relates to the field of configuration and manufacture of aluminum alloy smelting furnace burners, and in particular to a device and a method of regulating a melting speed of an aluminum alloy smelting furnace burner.

BACKGROUND

Aluminum alloys are non-ferrous materials that are the most commonly and widely used in various industries. The aluminum alloy has good physical and chemical properties and can be easily processed and recycled. Casting is a common technology of processing the aluminum alloy, and 30% of aluminum alloy products are produced in this way. Melting is the first process during the aluminum alloy casting process, has high energy consumption, and generates high emissions. An important demand in the aluminum alloy casting industry in the art is to develop an intelligent aluminum alloy smelting furnace to achieve aluminum alloy melting, which has a high energy efficiency, a high efficiency, a high product quality, and a low emission. Accurately measuring and controlling a melting speed of the aluminum alloy smelting process is a key function of a highly intelligent aluminum alloy smelting furnace. However, the smelting furnace in the art does not have this function. Accurately measuring and controlling the melting speed of the aluminum alloy smelting process has significantly influence in intelligent and low-carbon operation of the aluminum alloy smelting process. The influence is shown as: a state of the smelting process being displayed in real time (the melting speed, energy consumption, a melting energy efficiency, and so on are displayed in real time), such that the melting energy efficiency may be improved, a melting amount may be accurately controlled, and accuracy of supplying an aluminum liquid may be improved.

However, in the art, the melting speed of the burner in the aluminum alloy smelting process cannot be accurately measured and controlled. The aluminum alloy melting process is complex, and the melting speed of the aluminum alloy cannot be directly measured easily. For a method of controlling the melting speed of the aluminum alloy smelting furnace in the art, a melting speed of a melting chamber temperature is controlled in a closed-loop manner (assuming that the chamber temperature is constant, the melting speed is constant; and assuming that each chamber temperature corresponds to one melting speed); alternatively, a power of the burner is controlled (assuming that the power of the burner is constant, the melting speed is constant; and assuming that the power of each burner corresponds to one melting speed). The above two control methods have following three shortcomings. (1) The melting speed is unknown, i.e., the melting speed corresponding to the temperature of each furnace chamber or the power of each burner is unknown.

(2) The melting speed varies greatly. At a same furnace chamber temperature or a same power of the burner, positions, contact areas, ambient temperature, and other conditions of a to-be-melt aluminum alloy ingot may be dynamic, such that difference melting speeds may be achieved. (3) The melting speed of the burner is difficult to be controlled accurately. For the control method in the art, due to lack of feedback of actual melting speeds, it is difficult to accurately control the melting speed of the burner by relying only on theoretical models.

Accordingly, due to the technical problems that the melting speed of the burner in the aluminum alloy smelting process cannot be accurately measured and controlled, the present disclosure provides a technological research and develops a device and a method, which are low cost and highly reliable in accurately measuring and regulating the melting speed in the burner. In this way, energy consumption and carbon emission during the aluminum alloy smelting process may be reduced, such that the aluminum alloy casting industry may be upgraded to be a green industry and having low carbon emission.

SUMMARY OF THE DISCLOSURE

The present disclosure provides a device and a method of accurately regulating a melting speed of an aluminum alloy smelting furnace burner.

In a first aspect, the present disclosure provides the device of regulating the melting speed of an aluminum alloy smelting furnace. The device includes:

- a natural-gas flow-rate regulating assembly, configured to regulate a flow rate of natural gas;
- an air-flow regulating assembly, configured to regulate an air flow rate;
- a natural gas burner, connected to the natural-gas flow-rate regulating assembly and the air-flow regulating assembly; wherein, the natural gas burner is mounted in a melting zone of an aluminum alloy smelting furnace and is configured to melt an aluminum alloy ingot disposed in the melting zone of the aluminum alloy smelting furnace into an aluminum liquid, and the melted aluminum liquid is stored in an aluminum-liquid thermal-insulation pool of the aluminum alloy smelting furnace;
- a scum filtration assembly, comprising a ceramic tube, wherein, a bottom of the ceramic tube is connected to a ceramic filtration cylinder, a foam ceramic filtration plate is mounted inside the ceramic filtration cylinder, and the ceramic filtration cylinder is merged in the aluminum-liquid thermal-insulation pool of the aluminum alloy smelting furnace;
- an aluminum-liquid laser rangefinder, mounted above the scum filtration assembly;
- a controller, configured to: obtain a growth curve of a thickness of oxidation of the aluminum liquid by controlling the aluminum-liquid laser rangefinder and the scum filtration assembly to measure a height of the aluminum liquid in the aluminum-liquid thermal-insulation pool; obtain the height of the aluminum liquid in the aluminum-liquid thermal-insulation pool, and obtain a relationship between the height of the aluminum liquid in the aluminum-liquid thermal-insulation pool and a weight of the aluminum liquid; calculate weights of the aluminum liquid at two adjacent time points based on heights of the aluminum liquid at the two adjacent time points, thicknesses of the oxidation of the aluminum liquid at the two adjacent time points, and oxidation burning loss masses at the two adjacent time points; calculate an actual melting speed of the burner based on a difference in the weights of the aluminum liquid at the two adjacent time points; adjust the actual melting speed of the burner to reach a target melting speed of the burner by regulating the flow rate of the natural gas and the air flow rate.

In a second aspect, the present disclosure provides the method of regulating the melting speed of an aluminum alloy smelting furnace. The method can be performed by the device in the first aspect. The method includes:

setting a target melting speed of the burner;

calculating an initial flow rate of the natural gas and an initial air flow rate according to the target melting speed of the burner;

determining an actual melting speed of the burner;

adjusting the flow rate of the natural gas and the air flow rate based on a difference between the actual melting speed of the burner and the target melting speed of the burner, until the actual melting speed of the burner reaches the target melting speed of the burner.

The operation of determining the actual melting speed of the burner includes: obtaining a predetermined thickness function that describes a time-dependent growth curve of the thickness of an oxide layer on the aluminum liquid in the aluminum-liquid thermal-insulation pool, and determining an oxide layer thickness at each time point according to the predetermined thickness function; obtaining a predetermined weight function that describes a relationship between the height and the weight of the aluminum liquid in the aluminum-liquid thermal-insulation pool of the aluminum alloy smelting furnace; obtaining a height of the aluminum liquid in the aluminum-liquid thermal-insulation pool at each time point; calculating weights of the aluminum liquid corresponding to the two adjacent time points based on the predetermined weight function, heights of the aluminum liquid at the two adjacent time points, the oxide layer thicknesses at the two adjacent time points, and oxidation burning loss masses at the two adjacent time points; and calculating the actual melting speed of the burner based on the difference between the weights of the aluminum liquid at the two adjacent time points and a time difference between the two adjacent time points.

According to the present disclosure, following technical effects are achieved.

1. The device of the present disclosure is arranged with a scum filtration assembly. The scum filtration assembly includes a ceramic tube. A bottom of the ceramic tube is connected with a ceramic filtration cylinder. A foam ceramic filtration plate is mounted in the ceramic filtration cylinder. The ceramic filtration cylinder is merged in an aluminum-liquid thermal-insulation pool of the aluminum alloy smelting furnace. The scum filtration assembly and a rangefinder may measure a height of the aluminum liquid in the aluminum-liquid thermal-insulation pool to obtain a growth curve of a thickness of oxidation of the aluminum liquid. In this way, the actual melting speed of the burner can be accurately obtained accordingly.

2. In the method of the present disclosure, a process of obtaining the accurate actual melting speed of the burner is provided. The process includes: obtaining the growth curve of the thickness of the oxidation of the aluminum liquid by the rangefinder and the scum filtration assembly; obtaining a relationship between the height of the aluminum liquid and a weight of the aluminum liquid in the aluminum-liquid thermal-insulation pool of the aluminum alloy smelting furnace; obtaining a weight of the aluminum liquid at a time point and another weight of the aluminum liquid at an adjacent time point by calculating based on the heights of the aluminum liquid at the time point and at the adjacent time point, thicknesses of oxidation of the aluminum liquid at the time point and at the adjacent time point, and oxidation burning loss masses at the time point and at the adjacent time point; and obtaining the accurate actual melting speed of the burner based on a difference between the weight of the aluminum liquid at the time point and the weight of the aluminum liquid at the adjacent time point. By obtaining the accurate actual melting speed of the burner, energy consumption and carbon emission during the aluminum alloy smelting process may be reduced, and the aluminum alloy casting industry may be upgraded to be a green industry and having low carbon emission.

3. In the method of the present disclosure, a flow rate of the natural gas and an air flow rate are adjusted according to the difference between the actual melting speed of the burner and the target melting speed of the burner, until the actual melting speed of the burner reaches the target melting speed of the burner. The process herein is a double closed-loop control of the natural gas and the air flow rate for melting combustion. In this way, an air-fuel ratio may be regulated in real time. Compared to the method in the art, the present method enables a more efficient combustion efficiency and an oxidation burning loss to be achieved.

4. The method and the device of regulating the melting speed of the aluminum alloy smelting furnace burner in the present disclosure are effective and low cost, and can be applied easily. The method and the device of the present disclosure may be suitable for regulating melting speeds of various types of aluminum alloy smelting furnaces and can be rapidly promoted and applied. Large scaled application of the present invention is significant in achieving energy saving and carbon reduction in the aluminum alloy casting industry and in enabling the casting industry to be transferred to be a green and low-carbon emission industry.

BRIEF DESCRIPTION OF THE DRAWINGS

In order to more clearly illustrate the technical solutions in the embodiments of the present disclosure, the accompanying drawings for describing the embodiments will be briefly introduced below. Obviously, the accompanying drawings in the following description show only some embodiments of the present disclosure, and any ordinary skilled person in the art may obtain other drawings according to these drawings without making creative work.

Figure 1:
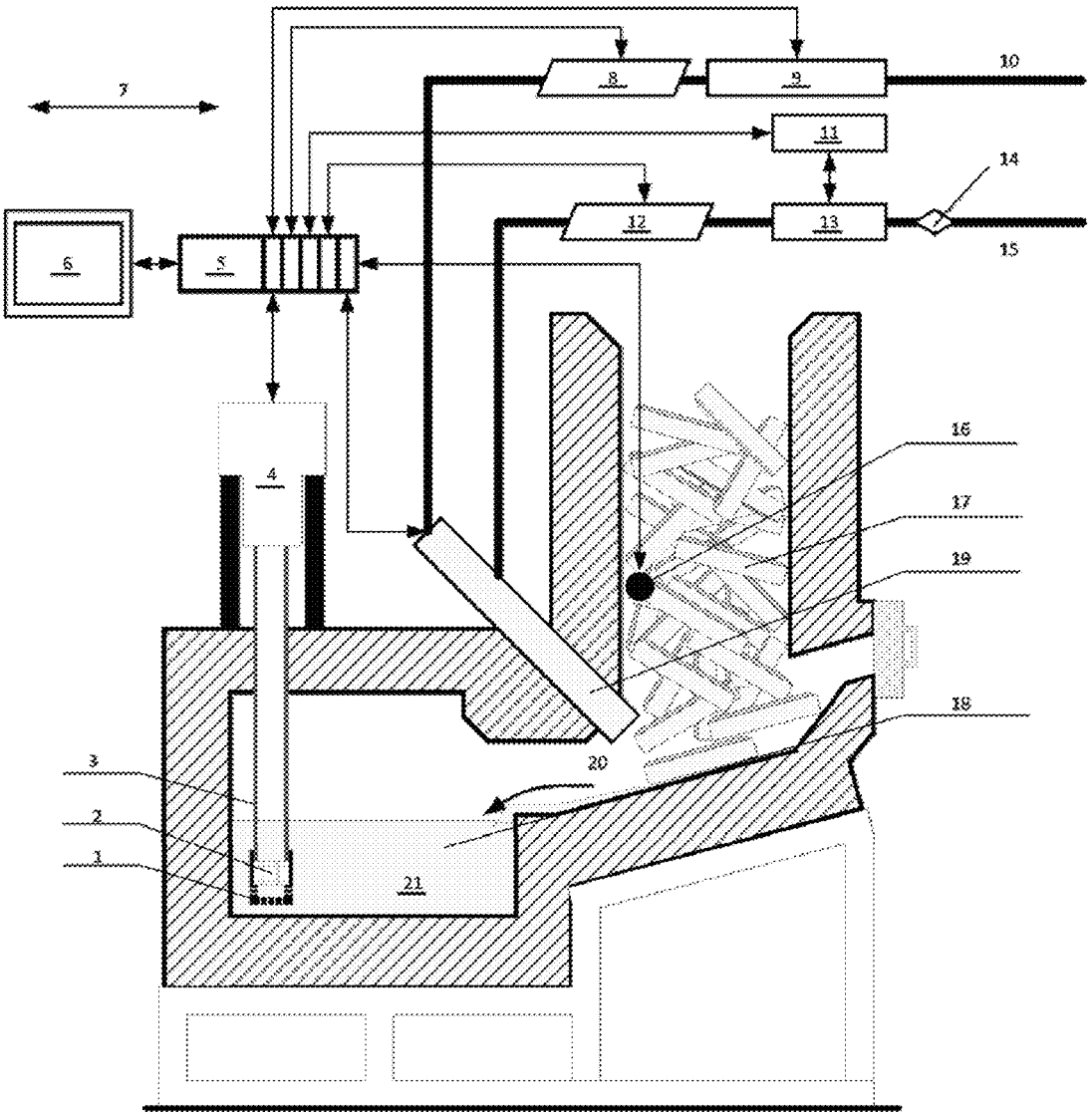
FIG. 1 is a diagram of a device of regulating a melting speed of an aluminum alloy smelting furnace burner according to an embodiment of the present disclosure.

Reference numerals in the drawings: 1—ceramic filtration cylinder, 2—foam ceramic filtration plate, 3—ceramic tube, 4—aluminum liquid laser rangefinder, 5—controller, 6—touch screen, 7—shielded twisted pair cable, 8—natural gas meter, 9—natural-gas flow-rate regulating valve, 10—natural gas inputting pipe, 11—frequency converter, 12—air flow meter, 13—blower, 14—air filter, 15—air inputting pipe, 16—temperature sensor, 17—aluminum alloy ingot, 18—aluminum liquid, 19—natural gas burner, 20—melting zone, 21—aluminum liquid thermal insulation zone.

DETAILED DESCRIPTION

Technical solutions in the embodiments of the present disclosure will be described clearly and completely in the following by referring to the accompanying drawings in the embodiments of the present disclosure. Obviously, the described embodiments are only a part of, not all of, the embodiments of the present disclosure. All other embodiments, which are obtained by any ordinary skilled person in the art based on the embodiments in the present disclosure without making creative work, shall fall within the scope of the present disclosure.

To be noted that the features in the following embodiments and implementations may be combined with each other without conflict.

In a first aspect, as shown in FIG. 1, the present disclosure provides a device of regulating a melting speed of an aluminum alloy smelting furnace burner. The device includes the following.

A natural-gas flow-rate regulating assembly is configured to regulate a flow rate of natural gas. The natural-gas flow-rate regulating assembly includes a natural-gas flow-rate regulating valve 9 and a natural gas meter 8 that are arranged sequentially on a natural gas inputting pipe 10.

An air-flow regulating assembly is configured to regulate an air flow rate. The air-flow regulating assembly includes a blower 13 and an air flow meter 12 that are arranged sequentially on an air inputting pipe 14. Further, the air inputting pipe 14 is further arranged with an air filter 14 at an inlet end of the blower 13.

A natural gas burner 19 is configured to be connected to the natural-gas flow-rate regulating assembly and the air-flow regulating assembly. The natural gas burner 19 is mounted in a melting zone 20 of the aluminum alloy smelting furnace and is configured to melt an aluminum alloy ingot 17 disposed in the melting zone of the aluminum alloy smelting furnace into molten aluminum liquid 18. In this way, the molten aluminum liquid 18 is stored in an aluminum-liquid thermal-insulation pool 21 of the aluminum alloy smelting furnace.

A frequency converter 11 is configured to control a rotational speed of the blower 13.

A scum filtration assembly is arranged, and includes a ceramic filtration cylinder 1, a foam ceramic filtration plate 2, and a ceramic tube 3. A bottom of the ceramic tube 3 is connected to the ceramic filtration cylinder 1. The foam ceramic filtration plate 2 is mounted inside the ceramic filtration cylinder 1. The ceramic filtration cylinder 1 is merged in the aluminum-liquid thermal-insulation pool 21 of the aluminum alloy smelting furnace.

An aluminum-liquid laser rangefinder 4 is mounted above the scum filtration assembly.

A controller 5 is configured to: obtain a predetermined thickness function that describes a time-dependent growth curve of a thickness of an oxide layer on the aluminum liquid in the aluminum-liquid thermal-insulation pool 21, and determine an oxide layer thickness at each time point according to the predetermined thickness function; obtain the height of the aluminum liquid in the aluminum-liquid thermal-insulation pool 21, and obtain a predetermined weight function that describes a relationship between a height and a weight of the aluminum liquid in the aluminum-liquid thermal-insulation pool 21; calculate weights of the aluminum liquid corresponding to two adjacent time points t and t−1 based on the predetermined weight function, heights of the aluminum liquid two adjacent time points, the oxide layer thicknesses at the two adjacent time points, and oxidation burning loss masses at the two adjacent time points; calculate the actual melting speed of the burner based on a difference between the weights of the aluminum liquid at the two adjacent time points and a time difference between the two adjacent time points; and enable an actual melting speed of the burner to reach a target melting speed of the burner by regulating the flow rate of the natural gas and the air flow rate.

Further, the device of regulating a melting speed of an aluminum alloy smelting furnace burner further includes the following.

A touch screen 6 is configured to display the flow rate of the natural gas, the actual melting speed of the aluminum liquid, and an energy efficiency of melting the aluminum. The touch screen 6 is connected and communicated with the controller by shielded twisted pair wires.

A temperature sensor 16 is mounted on a furnace wall of the melting zone of the aluminum alloy smelting furnace and is configured to measure a temperature of a furnace chamber.

The controller 5 is configured to: collect the temperature of the furnace chamber in real time; set a temperature threshold of the furnace chamber; and give an alarm when the temperature of the furnace chamber is higher than the temperature threshold of the furnace chamber.

Specifically, the ceramic filtration cylinder 1 is cylindrical. A step for fixing the foam ceramic filtration plate 2 is arranged on an inner wall of the ceramic filtration cylinder 1. A bottom and a side wall from the bottom to the step of the ceramic filtration cylinder 1 defines a plurality of through holes, and each of plurality of through holes has a diameter of less than 6 mm. A top inner wall of plurality of through holes is arranged with screw threads that can be connected with the ceramic tube. A sieve size of the foam ceramic filtration plate 2 is more than 50 mesh. A bottom outer wall of the ceramic tube 3 is arranged with screw threads to be connected with the ceramic filtration cylinder. The foam ceramic filtration plate 2 is mounted inside the ceramic filtration cylinder 1. The ceramic filtration cylinder 1 is connected to the ceramic tube 3 by threading. A portion of the furnace wall above the aluminum-liquid thermal-insulation pool 21 defines a hole, and the ceramic tube 3 is mounted in the hole. When mounting, it is to be ensured that an axis of the ceramic tube 3 is perpendicular to a liquid surface of the aluminum liquid, and a distance between the bottom of the ceramic filtration cylinder 1 and a bottom of the aluminum liquid thermal insulation zone 22 is in a range from 50 mm to 100 mm. In this way it is ensured that the ceramic filtration cylinder is fully merged into the aluminum liquid when the device is operating.

In the present example, a programmable logic controller (PLC) is configured as the controller. An accuracy of the aluminum-liquid laser rangefinder 4 is plus or minus 1 mm. A bracket is arranged to fixedly mount the aluminum-liquid laser rangefinder 4 above the ceramic tube. In this way, it is ensured that a measuring surface of the aluminum-liquid laser rangefinder 4 is parallel to the liquid surface of the aluminum liquid. The shielded twisted pair cables are used to enable the aluminum-liquid laser rangefinder 4 to be connected and communicated with the PLC.

Specifically, the natural gas burner 19, the natural-gas flow-rate regulating valve 9, the natural gas meter 8, the air flow meter 12, and the frequency converter 11 are connected and communicated with the PLC by the shielded twisted pair wires.

An operation process of the device of regulating the melting speed of the aluminum alloy smelting furnace burner is as follows. A user sets, through the touch screen, the target melting speed of the burner. The PLC receives the set speed, controls the frequency converter, the natural-gas flow-rate regulating valve, and the natural gas burner to operate, and receives real-time data from the natural gas meter and the air flow meter. The frequency converter controls the blower to send the set air flow rate to a natural gas burner. The natural-gas flow-rate regulating valve controls the flow rate of the natural gas to be the set target flow rate. During the melting process, the PLC processes data fed back from the aluminum-liquid laser rangefinder 4 and the natural gas meter and regulates states of the frequency converter, the natural-gas flow-rate regulating valve, and the natural gas burner, such that the melting speed is controlled accurately. During the melting process, the PLC obtains the real-time flow rate through the natural gas meter, obtains the real-time melting speed by processing the data fed back from the aluminum-liquid laser rangefinder 4 and the natural gas meter, calculates a melting energy efficiency, and sends the data to the touch screen to be displayed in real time. During the melting process, the PLC obtains, through the temperature sensor, the temperature of the furnace chamber in real time and gives an alarm in response to an abnormal temperature of the furnace chamber.

Figure 2:
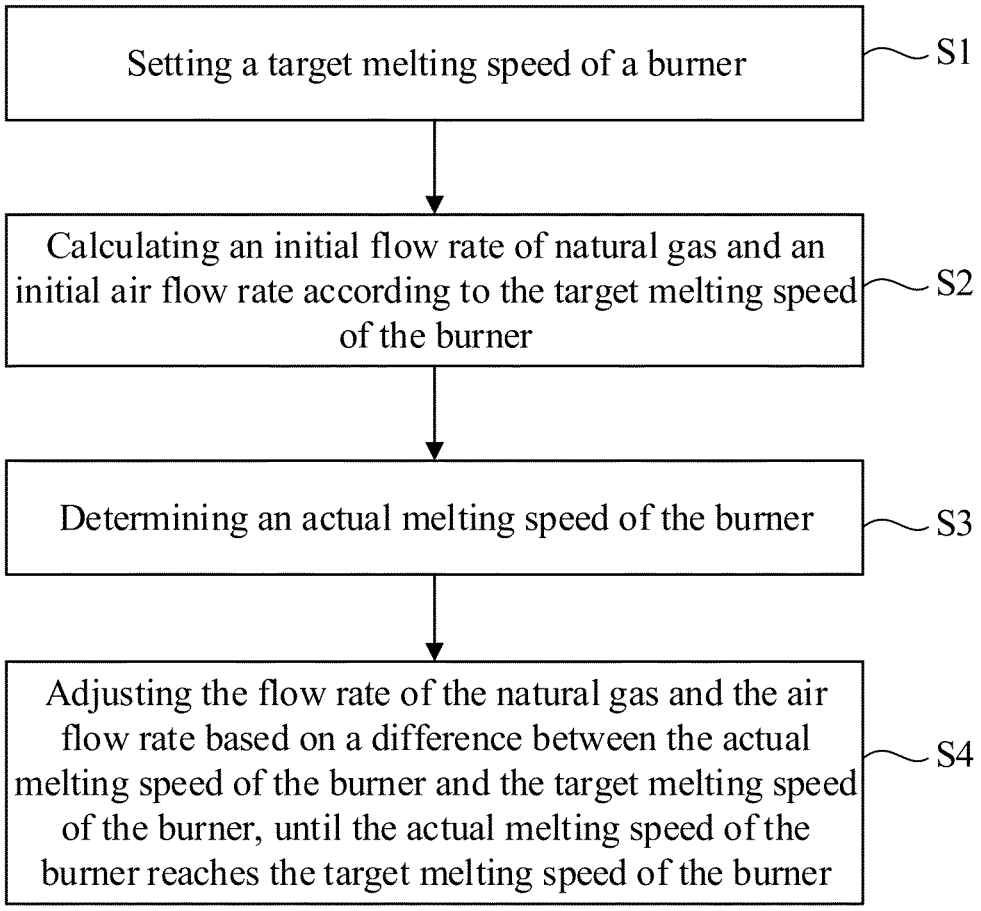
FIG. 2 is a flow chart of a method of regulating the melting speed of the aluminum alloy smelting furnace burner according to an embodiment of the present disclosure.

In a second aspect, as shown in FIG. 2, the present disclosure provides a method of regulating the melting speed of the aluminum alloy smelting furnace burner. The method includes following operations.

In an operation S1, the target melting speed of the burner is set.

In an operation S2, an initial flow rate of the natural gas and an initial air flow rate are calculated according to the target melting speed of the burner.

Further, equations for calculating the initial flow rate of the natural gas and the initial air flow rate are as follows:

$$Q_{ni} = (V_{mi} \times H_i)/(\eta_{mi} \times H_n), \text{ and}$$

$$Q_{ai} = Q_{ni} \times \alpha_c.$$

In the above equations, the $Q_{ni}$ is the flow rate of the natural gas ($m^3/h$), the $Q_{ai}$ is the air flow rate ($m^3/h$), the ac is an air-fuel ratio coefficient (the coefficient can be adjusted, and in the present example, the air-fuel ratio coefficient is set to 10), the $\eta_{mi}$ is an average energy efficiency of melting the aluminum alloy, the $V_{mi}$ is the target melting speed of the burner (kg/h), the $H_n$ is a calorific value of the natural gas ($kWh/m^3$), and the $H_i$ is a theoretical calorific value for melting a unit weight of the aluminum alloy (kWh/kg).

In an operation S3, the actual melting speed of the burner is determined.

Figure 3:
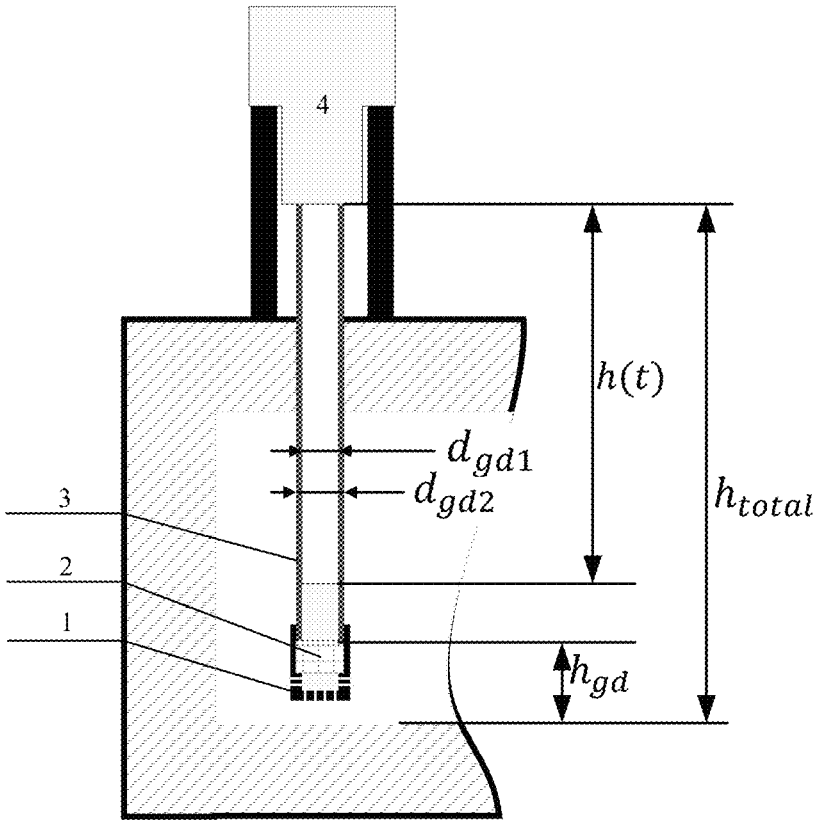
FIG. 3 is a diagram showing obtaining the actual melting speed of the burner according to an embodiment of the present disclosure.
Figure 4:
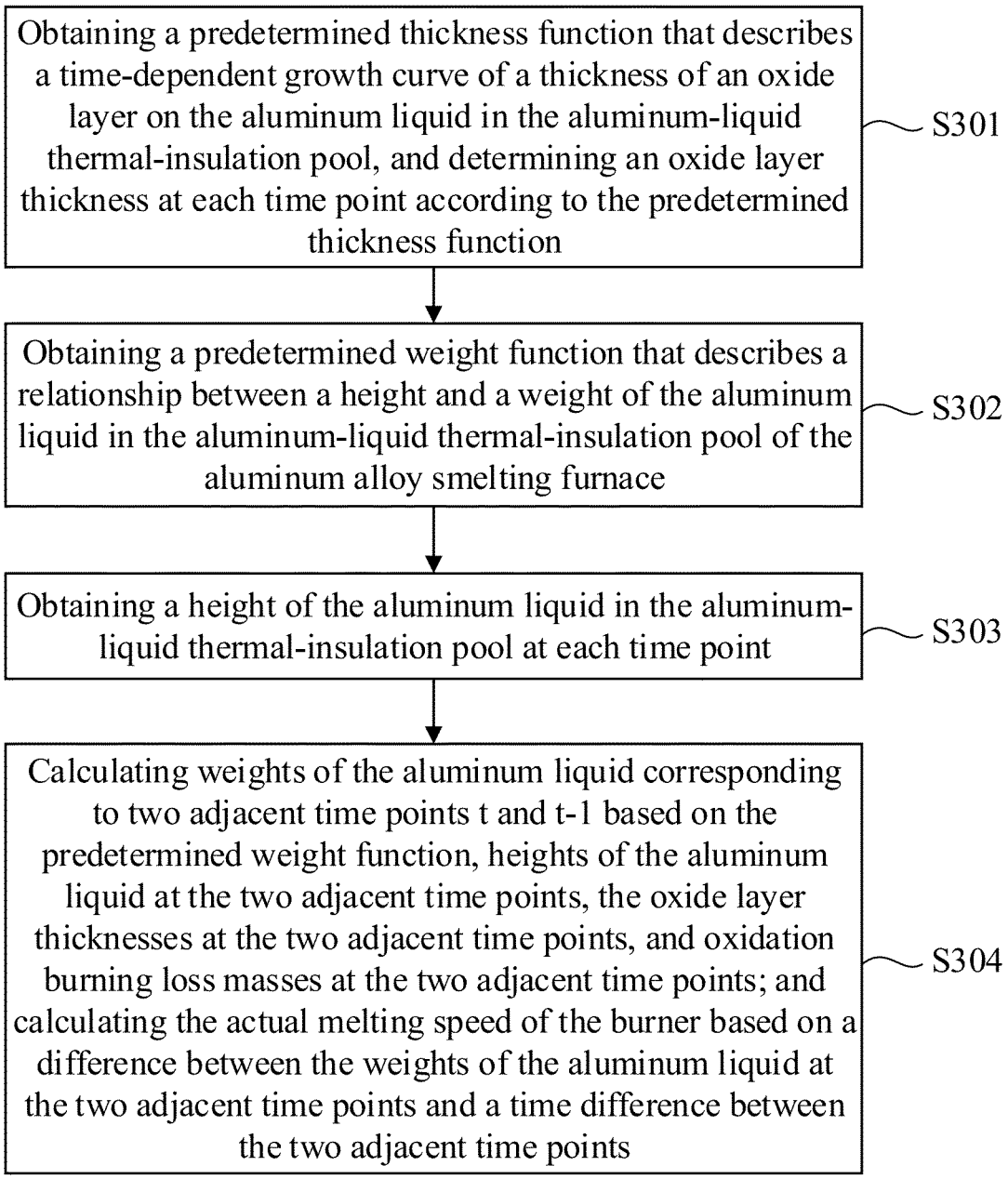
FIG. 4 is a flow chart of obtaining the actual melting speed of the burner according to an embodiment of the present disclosure.

Specifically, as shown in FIGS. 3 and 4, the operation S3 includes following operations.

In an operation S301, a predetermined thickness function that describes a time-dependent growth curve of a thickness of an oxide layer on the aluminum liquid in the aluminum-liquid thermal-insulation pool 21, is obtained, and an oxide layer thickness at each time point is determined according to the predetermined thickness function.

It is noted that the molten aluminum liquid in the aluminum-liquid thermal-insulation pool 21 undergoes slow oxidation upon exposure to air in the aluminum-liquid thermal-insulation pool 21, resulting in the formation of oxide scum/layer on the top surface of molten aluminum liquid. The thickness of this oxide layer varies over time; thus, the growth curve described by the thickness function can be used to quantify the time-dependent growth behavior of the oxide layer.

Figure 5:
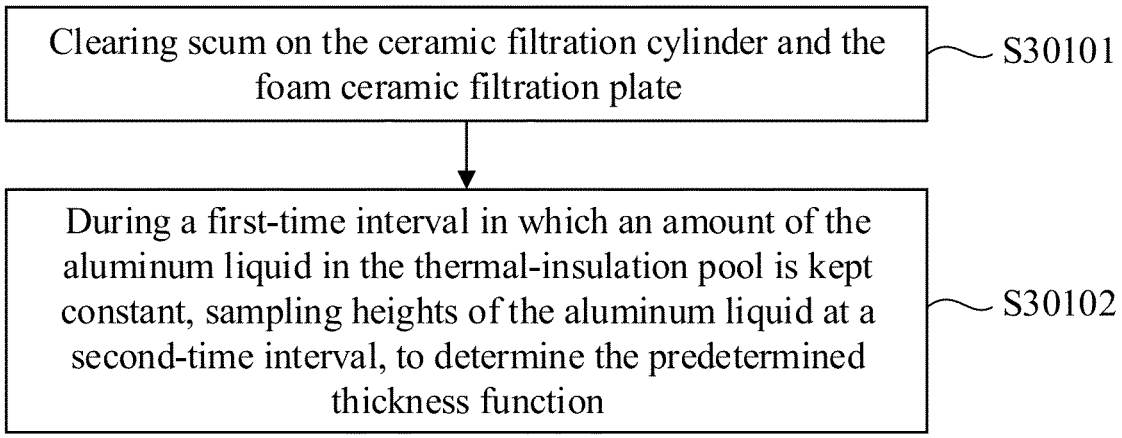
FIG. 5 is a flow chart of obtaining the growth curve of the thickness of the oxidation of the aluminum liquid according to an embodiment of the present disclosure.

In an embodiment, the thickness function is predetermined using the scum filtration assembly and the aluminum-liquid laser rangefinder 4 to perform measurement. Specifically, as shown in FIG. 5, the thickness function can be predetermined through the following procedure.

In an operation S30101, scum on the ceramic filtration cylinder 1 and the foam ceramic filtration plate 2 is cleared.

Specifically, the ceramic filtration cylinder 1 and the foam ceramic filtration plate 2 are removed from the ceramic tube 3, scum inside the ceramic filtration cylinder 1 and the foam ceramic filtration plate 2 are cleared, and the ceramic filtration cylinder 1 and the foam ceramic filtration plate 2 are mounted again.

In an operation S30102, during a first-time interval in which the amount of the aluminum liquid in the thermal-insulation pool 21 is kept constant, heights of the aluminum liquid are sampled by the aluminum-liquid laser rangefinder 4 at a second-time interval $\Delta t_2$. This process yields the growth curve of the oxide layer thickness over time on the aluminum liquid. The growth curve can be predetermined and described by the thickness function, which is represented as H(round ($t/\Delta t_2$)).

In the above expression, t=[0, $t_{h1}$] represents a sampling time point(s). The $t_{h1}$ denotes the duration of the first-time interval(s). The $\Delta t_2$ is the sampling period, i.e., the second-time interval (s). The function round( ) denotes rounding to the nearest integer. The H(.) represents the oxide layer thickness (m) as a a function of discretized time.

Specifically, the first-time interval $t_{h1}$ corresponds to the period between two consecutive clearing operations of scum from the ceramic filtration cylinder 1, the foam ceramic filtration plate 2, and the aluminum liquid thermal insulation zone 22. In the present embodiment, the first-time interval is 28,800 s, and the second-time interval Δt2 is 1 s.

In the operation S302, a predetermined weight function, which describes the relationship between the height and the weight of the aluminum liquid in the aluminum-liquid thermal-insulation pool 21 of the aluminum alloy smelting furnace, is obtained.

Figure 6:
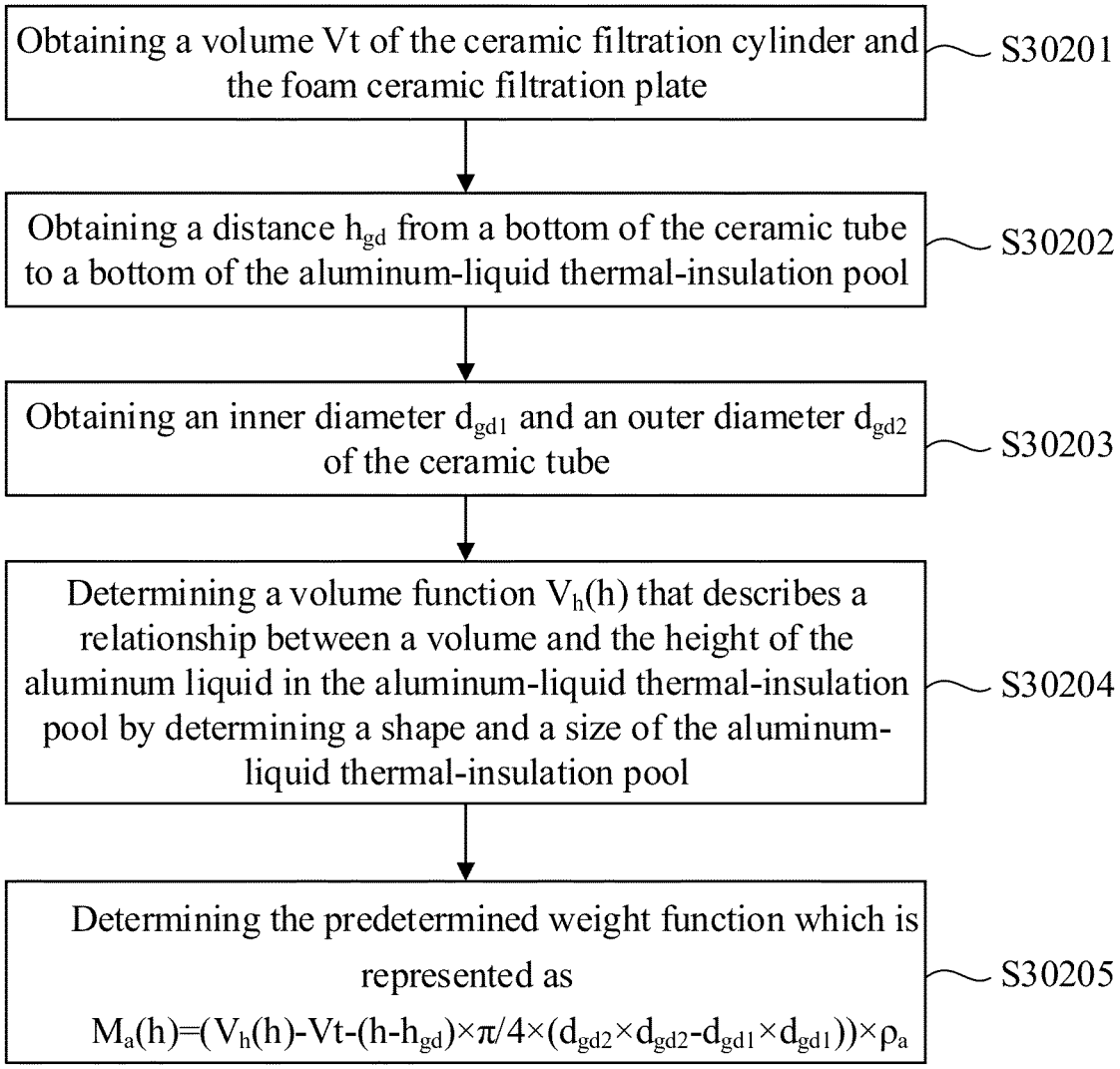
FIG. 6 is a flow chart of obtaining a relationship between a height of aluminum liquid and a weight of aluminum liquid in the aluminum-liquid thermal-insulation pool of the aluminum alloy smelting furnace according to an embodiment of the present disclosure.

In an embodiment, as shown in FIG. 6, the weight function can be predetermined through the following procedure.

In an operation S30201, a volume Vt ($m^3$) of the ceramic filtration cylinder 1 and the foam ceramic filtration plate 2 is obtained by modeling based on a three-dimensional digital model or by using a 3D scanner to perform scanning.

In an operation S30202, a distance $h_{gd}$(m) from the bottom of the ceramic tube 3 to the bottom of the aluminum-liquid thermal-insulation pool is obtained.

In an operation S30203, an inner diameter $d_{gd1}$(m) and an outer diameter $d_{gd2}$(m) of the ceramic tube 3 are obtained.

In an operation S30204, a shape and a size of the the aluminum-liquid thermal-insulation pool are determined by a three-dimensional digital model or a 3D scanner, to determine a volume function $V_h$(h) ($m^3$) that describes the relationship between the volume and the height of the aluminum liquid in the aluminum-liquid thermal-insulation pool.

In an operation S30205, the predetermined weight function that describes the relationship between the height and the weight of the aluminum liquid is represented by the following equation:

$$M_a(h) = \left(Vh(h) - Vt - (h - h_{gd}) \times \pi/4 \times (d_{gd2} \times d_{gd2} - d_{gd1} \times d_{gd1})\right) \times \rho_a$$

In the above equation, the $M_a$(h) is the predetermined weight function that describes the relationship between the height and the weight (kg) of the aluminum liquid in the thermal-insulation pool. The h is the height of the aluminum liquid (m). The $\rho_a$ is a density of the aluminum liquid (kg/$m^3$).

Due to the irregular geometry of the thermal insulation zone of the aluminum-liquid thermal-insulation pool, the relationship between the height and the weight of the molten aluminum liquid in the aluminum-liquid thermal-insulation pool remains indeterminate; therefore, operation S302 is employed to establish this relationship.

In an operation S303, a height of the aluminum liquid in the aluminum-liquid thermal-insulation pool at each time point is sampled.

In an operation S304, weights of the aluminum liquid corresponding to the adjacent time points respectively are calculated based on: the predetermined weight function, heights of the aluminum liquid at the adjacent time points, the oxide layer thicknesses at the adjacent time points, and oxidation burning loss masses at the adjacent time points; and the actual melting speed of the burner is calculated based on the difference between the weights of the aluminum liquid at the adjacent time points and a time difference between the two adjacent time points.

Figure 7:
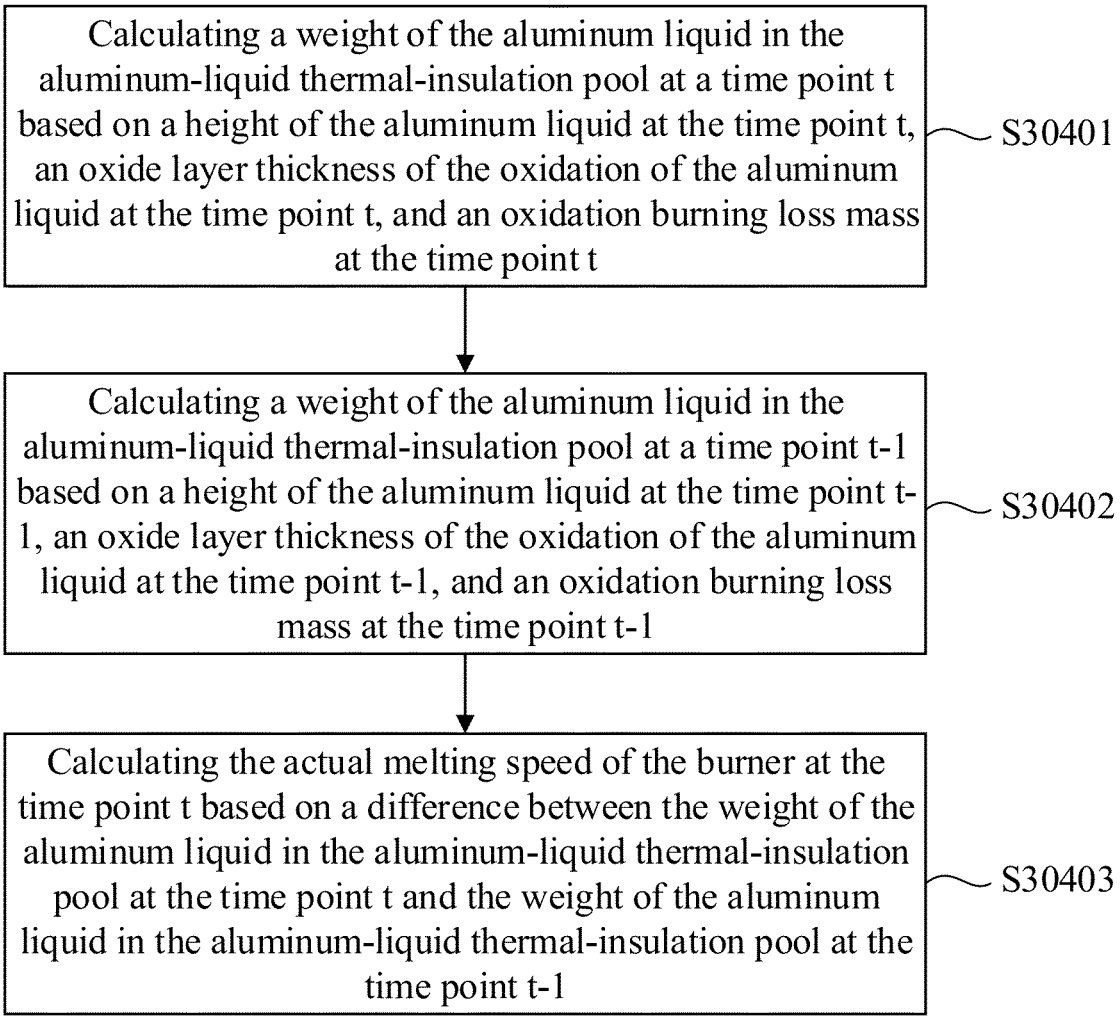
FIG. 7 is a flow chart of calculating a difference between a weight of aluminum liquid at a time point and another weight of aluminum liquid at an adjacent time point to obtain the actual melting seed of the burner according to an embodiment of the present disclosure.

Specifically, as shown in FIG. 7, the operation S304 includes following operations.

In an operation S30401, the weight of the aluminum liquid in the aluminum-liquid thermal-insulation pool at the time point t is calculated based on the height of the aluminum liquid at the time point t, the oxide layer thickness at the time point t, and the oxidation burning loss mass at the time point t. The calculation is as follows:

$$M_{as-t} = M_a(h_{total} - h(t) - H(t)) - M_1 - M_2;$$

$$M_1 = \frac{\alpha_1 * \rho_a}{3600 * \rho_f} * \int_0^t cmo_1 * Vm(t)^{1-cmo_2} dt;$$

-continued $$M_2 = \frac{\alpha_2}{3600 * \rho_f} * \int_0^t cmo_1 * Vm(t)^{1-cmo_2} dt.$$

In the above expression, the $M_{as-t}$ is the weight (kg) of the aluminum liquid in the aluminum-liquid thermal-insulation pool at the time point t; the $h_{total}$ is a distance (m) from the measuring surface of the aluminum-liquid laser rangefinder 4 to the bottom surface of the aluminum-liquid thermal-insulation pool of the smelting furnace; the h (t) is a distance (m), at the time point t, from the measuring surface of the aluminum-liquid laser rangefinder 4 to a top surface of the aluminum liquid in the aluminum-liquid thermal-insulation pool of the smelting furnace; the H(t) is the oxide layer thickness (m) at the time point t; the M1 is an increased weight (kg) of the aluminum liquid that is caused by scum of the oxidation burning loss being precipitated to the bottom of the aluminum liquid at the time point t; the M2 is an increased weight (kg) of the aluminum liquid that is caused by scum of the oxidation burning loss being floated on the top surface of the aluminum liquid at the time point t; the pa is the density of the aluminum liquid (kg/$m^3$); the $\rho_f$ is a density (kg/$m^3$) of the scum of the burning loss of the aluminum liquid; the $\alpha_1$ is a ratio coefficient of the scum of the oxidation burning loss being precipitated to the bottom of aluminum liquid; and the $\alpha_2$ is a ratio coefficient of the scum of the oxidation burning loss floating on the top surface of aluminum liquid. The $cmo_1$ and the $cmo_2$ are correlation coefficients of the melting speed to an oxidation burning loss rate. The $V_m$(t) is the melting speed (kg/h).

In an operation S30402, the weight of the aluminum liquid in the aluminum-liquid thermal-insulation pool at the time point t−1 is calculated based on the height of the aluminum liquid at the time point t−1, the oxide layer thickness at the time point t−1, and the oxidation burning loss mass at the time point t−1. The calculation is as follows:

$$M_{as-t-1} = M_a(h_{total} - h(t-1) - H(t-1)) - M_3 - M_4;$$

$$M_3 = \frac{\alpha_1 * \rho_a}{3600 * \rho_f} * \int_0^{t-1} cmo_1 * Vm(t)^{1-cmo_2} dt; \text{ and}$$

$$M_4 = \frac{\alpha_2}{3600 * \rho_f} * \int_0^{t-1} cmo_1 * Vm(t)^{1-cmo_2} dt.$$

In the above expression, the $M_{as-t-1}$ is the weight of the aluminum liquid in the aluminum-liquid thermal-insulation pool at the time point of t−1. The h(t−1) is the distance (m) from the measuring surface of the rangefinder to the top surface of the aluminum liquid in the aluminum-liquid thermal-insulation pool at the time point of t−1. The H(t−1) is the oxide layer thickness (m) at the time point of t−1. The M3 is an increased weight (kg) of the aluminum liquid that is caused by scum of the oxidation burning loss being precipitated to the bottom of the aluminum liquid at the time point t−1; the M4 is an increased weight (kg) of the aluminum liquid that is caused by scum of the oxidation burning loss being floated on a top surface of the aluminum liquid at the time point t−1. The Vm(t) is the melting speed (kg/h).

The oxide scum/layer formed on the top surface of the molten aluminum liquid and sunk to the bottom, may lead to an overestimation of the height of the aluminum liquid and thus requires correction when calculating the mass of molten aluminum liquid. Operations of S30401 and S30402 are employed to correct this discrepancy.

In an operation S30403, the actual melting speed of the burner at the time point t is calculated based on a difference between the weight of the aluminum liquid in the aluminum-liquid thermal-insulation pool at the time point t and the weight of the aluminum liquid in the aluminum-liquid thermal-insulation pool at the time point t−1. The calculation is as follows:

$$V_m(t) = (M_{as-t} - M_{as-t-1}) \times 3600/\Delta t_1$$

In the above expression, the Δt1 is a time difference(s) between the time point t and the time point t−1.

Further, when a certain amount of aluminum liquid is taken out of the thermal-insulation pool between the time point t and the time point t−1, the height of the aluminum liquid at the time point t is updated to be a sum of the height of the aluminum liquid sampled at the time point t and a reduced height of the aluminum liquid in the thermal-insulation pool. The calculation is as follows:

$$h(t) = \begin{cases} h(t), \text{ no aluminum liquid is taken between the time point } t \text{ and the time point } t-1 \\ h(t) + h_q, \text{ aluminum liquid is taken between the time point } t \text{ and the time point } t-1 \end{cases}$$

The $h_q$ is the reduced height (m) of the aluminum liquid in the thermal-insulation pool after the certain amount of aluminum liquid is taken.

Further, a difference between the height of the aluminum liquid at the time point t and the height of the aluminum liquid at the time point t−1 is calculated. A height difference threshold is set (in the present example, the height difference threshold is set as Vm(t−1)/900, and the Vm(t−1) is the melting speed of the burner at the time point t−1). When the difference between the height of the aluminum liquid at the time point t and the height of the aluminum liquid at the time point t−1 is greater than the height difference threshold, it is determined that an abrupt change occurs between the melting speed at the time point t and the melting speed at the time point t−1 (due to a large amount of un-melted aluminum alloy ingot dropping into the aluminum liquid). The height of the aluminum liquid at the time point t is updated to be a difference between the height of the aluminum liquid collected at the time point t and a height of the aluminum liquid corresponding to the abrupt change in the melting speed. The height of the aluminum liquid corresponding to the abrupt change in the melting speed is a difference between the height difference of the aluminum liquid corresponding to the time point t and the time point t−1 and the height difference threshold. The calculation is as follows:

$$h(t) = \begin{cases} h(t), \text{ no abrupt change in the melting speeds at the time point } t \text{ and the time point } t-1 \\ h(t) - h_{yc}, \text{ abrupt change in the melting speeds at the time point } t \text{ and the time point } t-1 \end{cases}$$

In the above expression, the $h_{yc}$ is the height (m) corresponding to the abrupt change in the melting speed.

In an operation S4, the flow rate of the natural gas and the air flow rate are adjusted based on the difference between the actual melting speed of the burner and the target melting speed of the burner, until the actual melting speed of the burner reaches the target melting speed of the burner.

Figure 8:
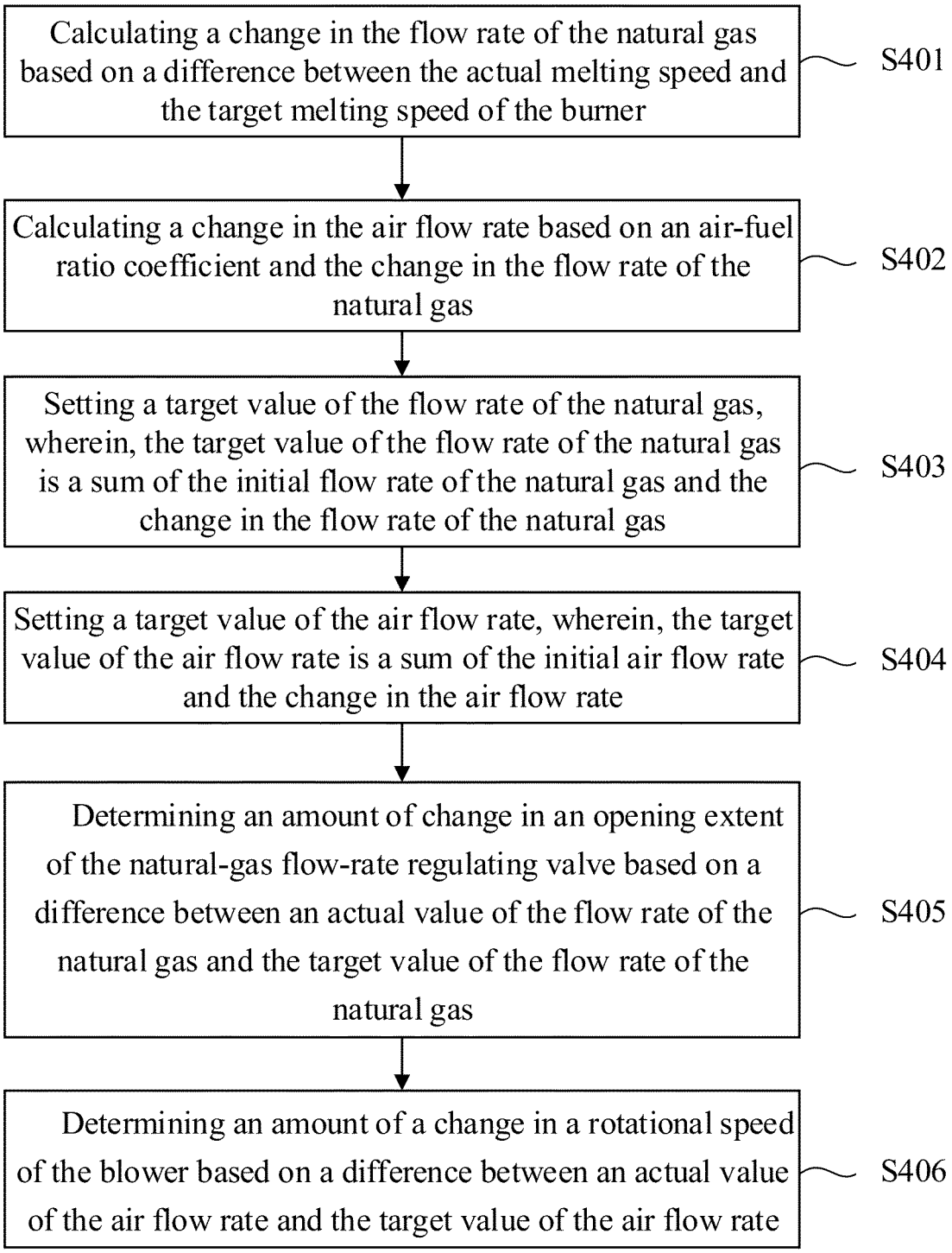
FIG. 8 is a flow chart of adjusting a flow rate of the natural gas and an air flow rate according to an embodiment of the present disclosure.

Specifically, as shown in FIG. 8, the operation S4 includes following operations.

In an operation S401, a change in the flow rate of the natural gas $\Delta Q_{ni}(t)$ ($m^3/h$) is calculated based on a difference $\Delta V_m(t)$ (kg/h) between the actual melting speed and the target melting speed of the burner.

In an operation S402, a change in the air flow rate $\Delta Q_{ai}(t)$ ($m^3/h$) is calculated based on the air-fuel ratio coefficient dc and the change in the flow rate of the natural gas$\Delta Q_{ni}(t)$. The calculation is as follows:

$$\Delta Q_{ni}(t) = K_{P1} * \Delta V_m(t) + K_{I1} * \int_0^t \Delta V_m(t)dt + K_{D1} * \frac{d(\Delta V_m(t))}{dt}$$

$$\Delta Q_{ai}(t) = \alpha_c * \Delta Q_{ni}(t)$$

In the above expression, the $K_{p1}$ is a proportional gain, the $K_{I1}$ is an integral time constant, and the $K_{D1}$ is a differential time constant.

In an operation S403, a target value of the flow rate of the natural gas is set. The target value of the flow rate of the natural gas is a sum of the initial flow rate of the natural gas and the change in the flow rate of the natural gas.

In an operation S404, a target value of the air flow rate is set. The target value of the air flow rate is a sum of the initial air flow rate and the change in the air flow rate.

In an operation S405, the amount of change in the opening extent of the natural-gas flow-rate regulating valve is determined based on a difference $\Delta Q_{ns}(t)$ ($m^3/h$) between the actual value of the flow rate of the natural gas and the target value of the flow rate of the natural gas. The calculation is as follows:

$$\Delta K_{ns}(t) = K_{P2} * \Delta Q_{ns}(t) + K_{I2} * \int_0^t \Delta Q_{ns}(t)dt + K_{D2} * \frac{d(\Delta Q_{ns}(t))}{dt}$$

In the above expression, the $K_{p2}$ is a proportional gain, the $K_{I2}$ is an integral time constant, and the $K_{D2}$ is a differential time constant.

In an operation S406, the amount of a change $\Delta N_{as}(t)$ (r/h) in a rotational speed of the blower is determined based on a difference $\Delta Q_{as}(t)$ ($m^3/h$) between the actual value of the air flow rate and the target value of the air flow rate. The calculation is as follows:

$$\Delta N_{as}(t) = K_{P3} * \Delta Q_{as}(t) + K_{I3} * \int_0^t \Delta Q_{as}(t)dt + K_{D3} * \frac{d(\Delta Q_{as}(t))}{dt}$$

In the above expression, the Kp3 is a proportional gain, the $K_{I3}$ is an integral time constant, and the $K_{D3}$ is a differential time constant.

It should be noted that the opening extent of the natural-gas flow-rate regulating valve is obtained by calculating a function of the flow rate of the regulating valve with respect to the opening extent and a pressure. The function of the flow rate of the regulating valve with respect to the opening extent and a pressure is known. An equation for calculating the rotational speed of the blower is $n=Q_a/V_g$. The n is the rotational speed of the blower (r/h), the $Q_a$ is a given air flow rate ($m^3/h$), and the $V_g$ is a volume of the blower ($m^3/r$).

Further, the method of regulating the melting speed of the aluminum alloy smelting furnace burner further includes following operations.

The values of the flow rate of the natural gas flow rate ($m^3$/h), the actual aluminum melting speed (kg/h), and the energy efficiency of melting the aluminum are displayed in real time on the touch screen.

The flow rate of the natural gas in real time is represented as:

$$\frac{G_s - G_{s-1}}{\Delta t_1} * 3600$$

In the above expression, the $G_s$ is an accumulative flow rate ($m^3$) obtained from the natural gas meter at the time point t. The $G_{s-1}$ is an accumulative flow rate ($m^3$) obtained from the natural gas meter at the time point t−1. The Δt1 is a time interval between the time point t and the time point t−1 (set to 10s in the present embodiment).

The energy efficiency of melting the aluminum is represented as follows:

$$\eta_m = (Q_n \times H_n)/(V_m \times H_i)$$

In the above expression, the $\eta_m$ is the energy efficiency of melting the aluminum. The $Q_n$ is the real-time flow rate of the natural gas ($m^3$/h). The $H_n$ is the calorific value of the natural gas (kWh/$m^3$). The $V_m$ is the real-time melting speed of the aluminum alloy (kg/h). The $H_i$ is a theoretical calorific value for melting a unit weight of the aluminum alloy (kWh/kg).

Further, the method of regulating the melting speed of the aluminum alloy smelting furnace burner further includes: giving the alarm in response to abnormality during the melting process. Specifically, data of the temperature sensor mounted in the melting zone is obtained in real time. When the data of the temperature sensor exceeds a set threshold (1200 degrees in the present embodiment), the controller sends an alarm signal, and a state of the natural gas burner is switched to be standby.

Embodiment 1

In the following, a tower-type aluminum alloy smelting furnace for casting having a maximum melting speed of 1.2 tons per hour is taken as an example to illustrate specific embodiment of the device and the method of regulating the melting speed of the aluminum alloy smelting furnace burner of the present disclosure.

In an operation 1, components are selected.

The ceramic tube has a length of 2 m, an outer diameter of 150 mm, an inner diameter of 100 mm. The ceramic filtration cylinder has an outer diameter of 200 mm, a height of 250 mm, an inner diameter of 150 mm above the step, an inner diameter of 120 mm below the step. A height of the step is 100 mm. The bottom and the wall of the step defines a through hole having a diameter of 5 mm. The foam ceramic filtration plate has a height of 100 mm, a diameter of 120 mm, and a mesh of 60. A model of the aluminum-liquid laser rangefinder is MSE-AL30. The aluminum-liquid laser rangefinder has an accuracy of ±1 mm, an operating temperature at −10° C.~+50° C., and a measuring range of 0.1~10 m. A communication interface of the aluminum-liquid laser rangefinder is RS-232.

A model of the PLC is Omron CP1H-X40DR-A. The PLC has input points of 24 and output points of 16. A model of the touch screen is Siemens KTP400. A model of the natural gas burner is BJ-400. The natural gas burner has a power of 2508MJ/h. A model of the natural-gas flow-rate regulating valve is 381LSA-08. A model of the natural gas meter is RW-LUX. A communication interface of the natural gas meter is RS-485. The blower is a whirlpool fan from JINGONG. The frequency converter is delta CP2000 series. A model of the air flow meter is LC-LWQ, and a communication interface of the air flow meter is RS-485. The air filter is arranged. A maximum measurable temperature of the temperature sensor is 1500 degrees. The natural gas inputting pipe, the air inputting pipe, the air filter, and the shielded twisted pair cables are in common models.

In an operation 2, the device for regulating the melting speed of the aluminum alloy smelting furnace burner is assembled.

The foam ceramic filtration plate is mounted inside the ceramic filtration cylinder. The ceramic filtration cylinder is connected to the ceramic tube by threading. A portion of the furnace wall above the aluminum-liquid thermal-insulation pool defines a hole, and the ceramic tube is mounted in the hole. When mounting, it is to be ensured that the axis of the ceramic tube is perpendicular to the liquid surface of the aluminum liquid, and the distance between the bottom of the ceramic filtration cylinder and the bottom of the aluminum-liquid thermal-insulation pool is 60 mm. The bracket is arranged to fixedly mount the aluminum-liquid laser rangefinder to the above of the ceramic tube, ensuring that the measuring surface of the aluminum-liquid laser rangefinder is parallel to the liquid surface of the aluminum liquid. The aluminum-liquid laser rangefinder is connected to the Omron PLC by the shielded twisted pair cables. Communication between the aluminum-liquid laser rangefinder and the Omron PLC is achieved based on a communication protocol of the aluminum-liquid laser rangefinder.

The shielded twisted pair cables enable the Siemens touch screen, which is configured to set the melting speed and display melting records, to be connected to the OMRON PLC and enable mutual communication between the Siemens touch screen and the OMRON PLC to be achieved according to the communication protocol of the touch screen.

The furnace wall in the melting zone of the smelting furnace defines a hole in which the natural gas burner is mounted. The shielded twisted pair cables are configured to connect the natural gas burner to the OMRON PLC, and the mutual communication between the natural gas burner and OMRON PLC is achieved according to the communication protocol of the natural gas burner. The natural gas inputting pipe is arranged to connect the melting burner with a natural gas source. The natural-gas flow-rate regulating valve and the natural gas meter are mounted on the natural gas inputting pipe. The natural gas meter is disposed between the natural gas burner and the natural-gas flow-rate regulating valve. The shielded twisted pair cables are arranged to enable the natural-gas flow-rate regulating valve, the natural gas meter, and OMRON PLC to be connected to each other. Communication between the natural-gas flow-rate regulating valve and the OMRON PLC is achieved based on the communication protocol of the natural-gas flow-rate regulating valve, and communication between the natural gas meter and the OMRON PLC is achieved based on the communication protocol of the natural gas meter. The air inputting pipe is arranged to connect the melting burner with an air source. The blower, the air filter, and the air flow meter are mounted on the air inputting pipe. The air flow meter is disposed between the natural gas burner and the blower, and the blower is disposed between the air filter and the air flow meter. The blower is configured with the frequency converter and is connected to the frequency converter with an electric wire. The shielded twisted pair cables are arranged to enable the air flow meter, the frequency converter, and the Omron PLC to be connected to each other. Communication between the air flow meter and the OMRON PLC is achieved based on the communication protocol of the air flow meter, and communication between the frequency converter and the OMRON PLC is achieved based on the communication protocol of the frequency converter.

The temperature sensor for measuring the temperature of the furnace chamber is mounted on the furnace wall of the melting zone. The shielded twisted pair cable is arranged to connect the temperature sensor to the OMRON PLC. Communication between the temperature sensor and the OMRON PLC is achieved based on the communication protocol of the temperature sensor.

In an operation 3, the device of regulating the melting speed of the aluminum alloy smelting furnace burner regulates the melting speed.

Test methods are performed to obtain: the growth curve of an oxidation burning loss thickness of the aluminum liquid, an oxidation burning loss coefficient model, a ratio coefficient that the oxidation burning loss scum precipitates to the bottom of the aluminum liquid, and a ratio coefficient that the oxidation burning loss scum floats on the surface of the aluminum liquid. The relationship between the height of the aluminum liquid and the weight of the aluminum liquid in the thermal-insulation pool is measured according to the three-dimensional digital model. Parameters of a PID control algorithm for the flow rate of the natural gas and the air flow rate are set based on the empirical data and experiments.

The melting speed of the burner is set to 400 kg/h, and the melting is performed for one hour. The melting process ensures that sufficient aluminum ingots are present in a melting pre-heating zone. The amount of the aluminum liquid in the aluminum-liquid thermal-insulation pool is measured and recorded before the melting is started. The amount of the aluminum liquid in the aluminum-liquid thermal-insulation pool is measured and recorded again, after each melting is finished. The amount of aluminum ingots being melted in one hour is calculated. The melting speed is increased by 100 kg/h until reaching 1200 kg/h. The operation of measuring and recording the amount of aluminum liquid in the aluminum-liquid thermal-insulation pool is performed repetitively, so as to calculate the amount of aluminum ingots being melted within one hour corresponding to each melting speed. A rate of a difference between the set melting speed and the measured melting speed is calculated as: (set melting speed-measured melting speed)/set melting speed. Results are shown in Table 1 below, and an error of the melting speed is controlled within ±1%, meeting industrial requirements.

TABLE 1

Rate of difference between the set melting speed and the measured melting speed

| Serial No. | set melting speed (kg/h) | the amount (kg) of aluminum ingots being melted within one hour | rate of difference between melting speeds |
|---|---|---|---|
| 1 | 400 | 402.3 | −0.58% |
| 2 | 500 | 504.3 | −0.86% |
| 3 | 600 | 598.6 | 0.23% |
| 4 | 700 | 706.2 | −0.89% |
| 5 | 800 | 796.2 | 0.47% |
| 6 | 900 | 904.6 | −0.51% |
| 7 | 1000 | 1009.6 | −0.96% |
| 8 | 1100 | 1096.2 | 0.35% |
| 9 | 1200 | 1192.5 | 0.63% |

Any ordinary skilled person in the art shall understand that embodiments of the present disclosure may be provided as methods, systems, or computer program products. Therefore, the present disclosure may be represented in the form of a fully hardware embodiment, a fully software embodiment, or an embodiment that combines software and hardware aspects. Further, the present disclosure may be represented in the form of a computer program product implemented on one or more computer-usable storage media (including, but not limited to, a disk memory, CD-ROM, an optical memory, and the like) that include computer-usable program codes.

The present disclosure is described by referring to flow charts and/or block diagrams of methods, devices (systems), and computer program products of embodiments of the present disclosure. It is understood that each of the processes and/or blocks in the flow charts and/or block diagrams, and combinations of the processes and/or blocks in the flow charts and/or block diagrams, may be implemented by computer program instructions. These computer program instructions may be provided to a processor of a general-purpose computer, a special-purpose computer, an embedded processor, or other programmable data-processing device to produce a machine, such that the instructions executed by the processor of the computer or other programmable data-processing device produce a device for performing the functions specified in the one process or multiple processes of the flow chart and/or the one or more blocks of the block diagram.

These computer program instructions may also be stored in computer-readable memory capable of directing a computer or other programmable data processing device to operate in a particular manner, such that the instructions stored in the computer-readable memory produce an article including an instruction device that implements the function specified in one or more of the operations of the flow chart and/or one or more blocks of the block diagram.

These computer program instructions may also be loaded onto a computer or other programmable data processing device, such that a series of operations are performed on the computer or other programmable device to produce computer-implemented processing, such that the instructions executed on the computer or other programmable device provide operations for implementing the functions specified in the one or more operations of the flow chart and/or the one or more blocks of the block diagram.

The above embodiments are only used to illustrate the concepts and features of the present disclosure, and are intended to enable any ordinary skilled person in the art to understand the content of the present disclosure and implement the present disclosure accordingly. The scope of the present disclosure is not limited to the above embodiments. Therefore, any equivalent changes or modifications based on the principles and concepts in the present disclosure are within the scope of the present disclosure.

What is claimed is:

1. A method of regulating a melting speed of an aluminum alloy smelting furnace burner, the method being performed by a device that comprises a natural gas burner, a scum filtration assembly and an aluminum-liquid laser rangefinder; wherein the natural gas burner is mounted in a melting zone of an aluminum alloy smelting furnace and is configured to melt an aluminum alloy ingot disposed in the melting zone of the aluminum alloy smelting furnace into an aluminum liquid, wherein the melted aluminum liquid is stored in an aluminum-liquid thermal-insulation pool of the aluminum alloy smelting furnace; the scum filtration assembly comprises a ceramic tube, a ceramic filtration cylinder, and a foam ceramic filtration plate; wherein a bottom of the ceramic tube is connected to the ceramic filtration cylinder, the foam ceramic filtration plate is mounted inside the ceramic filtration cylinder, and the ceramic filtration cylinder is merged in the aluminum-liquid thermal-insulation pool of the aluminum alloy smelting furnace; the aluminum-liquid laser rangefinder is mounted above the scum filtration assembly; wherein the method comprises:

setting a target melting speed of the burner;

calculating an initial flow rate of natural gas and an initial air flow rate according to the target melting speed of the burner, wherein:

$$Q_{ni}=(V_{mi}\times H_i)/(\eta_{mi}\times H_n),\text{ and } Q_{ai}=Q_{ni}\times\alpha_c,$$

wherein, $Q_{ni}$ is the flow rate of the natural gas ($m^3/h$), $Q_{ai}$ is the air flow rate ($m^3/h$), $V_{mi}$ is the target melting speed of the burner (kg/h), $H_i$ is a theoretical calorific value for melting a unit weight of aluminum alloy (kWh/kg), $\eta_{mi}$ is an average energy efficiency of melting the aluminum alloy, $H_n$ is a calorific value of the natural gas ($kWh/m^3$), $\alpha_c$ is an air-fuel ratio coefficient;

determining an actual melting speed of the burner;

adjusting the flow rate of the natural gas and the air flow rate based on a difference between the actual melting speed of the burner and the target melting speed of the burner, until the actual melting speed of the burner reaches the target melting speed of the burner;

wherein, determining the actual melting speed of the burner comprises:

obtaining a thickness function that describes a time-dependent growth curve of a thickness of an oxide layer on the aluminum liquid in the aluminum-liquid thermal-insulation pool, and determining an oxide layer thickness at each time point according to the thickness function, wherein each time point is a time point at which the thickness of the oxide layer on the aluminum liquid is sampled for obtaining the thickness function;

obtaining a weight function that describes a relationship between a height and a weight of the aluminum liquid in the aluminum-liquid thermal-insulation pool of the aluminum alloy smelting furnace;

obtaining a height of the aluminum liquid in the aluminum-liquid thermal-insulation pool at each time point, wherein each time point is a time point at which the height of the aluminum liquid is sampled for obtaining the weight function;

calculating weights of the aluminum liquid corresponding to two adjacent time points t and t−1 based on the weight function, heights of the aluminum liquid at the two adjacent time points, the oxide layer thicknesses at the two adjacent time points, and oxidation burning loss masses at the two adjacent time points; and calculating the actual melting speed of the burner based on a difference between the weights of the aluminum liquid at the two adjacent time points and a time difference between the two adjacent time points;

wherein, the thickness function is obtained by performing following operations:

clearing scum on the ceramic filtration cylinder and the foam ceramic filtration plate;

within a first-time interval in which an amount of the aluminum liquid in the thermal-insulation pool is kept constant, sampling heights of the aluminum liquid at a plurality of time points to determine the thickness function which is represented as: H(round ($t/\Delta t_2$)); wherein a second time interval is between every two of the plurality of time points;

wherein, $t\in[0,t_{h1}]$ represents a sampling time point, the $t_{h1}$ denotes a duration of first-time interval, the $\Delta t_2$ is the second-time interval, the round( ) denotes rounding to the nearest integer, and the H(.) represents the oxide layer thickness;

wherein the weight function is obtained by performing following operations:

obtaining a volume Vt of the ceramic filtration cylinder and the foam ceramic filtration plate;

obtaining a distance $h_{gd}$ from a bottom of the ceramic tube to a bottom of the aluminum-liquid thermal-insulation pool;

obtaining an inner diameter $d_{gd1}$ and an outer diameter $d_{gd2}$ of the ceramic tube;

determining a volume function $V_h(h)$ that describes a relationship between a volume and the height of the aluminum liquid in the aluminum-liquid thermal-insulation pool by determining a shape and a size of the aluminum-liquid thermal-insulation pool;

determining the weight function which is represented as follows:

$$M_a(h)=(V_h(h)-Vt-(h-h_{gd})\times\pi/4\times(d_{gd2}\times d_{gd2}-d_{gd1}\times d_{gd1})\rho_a$$

wherein, the $M_a(h)$ is the weight function, the h is the height of the aluminum liquid, and the $\rho_a$ is a density of the aluminum liquid.

2. The method according to claim 1, wherein, the operation of calculating weights of the aluminum liquid corresponding to the two adjacent time points t and t−1 based on the weight function, heights of the aluminum liquid at the two adjacent time points, the oxide layer thicknesses at the two adjacent time points, and oxidation burning loss masses at the two adjacent time points; and calculating the actual melting speed of the burner based on the difference between the weights of the aluminum liquid at the two adjacent time points, comprises:

calculating a weight of the aluminum liquid in the aluminum-liquid thermal-insulation pool at a time point t based on a height of the aluminum liquid at the time point t, an oxide layer thickness at the time point t, and an oxidation burning loss mass at the time point t, by following an equation as follows:

$$M_{as\text{-}t}=M_a(h_{total}-h(t)-H(t))-M_1-M_2;$$

wherein, the $M_{as\text{-}t}$ is the weight of the aluminum liquid in the aluminum-liquid thermal-insulation pool at the time point t; the $h_{total}$ is a distance from a measuring surface of the aluminum-liquid laser rangefinder to a bottom surface of the aluminum-liquid thermal-insulation pool of the smelting furnace; the h(t) is a distance, at the time point t, from the measuring surface of the aluminum-liquid laser rangefinder to a top surface of the aluminum liquid in the aluminum-liquid thermal-insulation pool of the smelting furnace; the H(t) is the oxide layer thickness at the time point t; the M1 is an increased weight of the aluminum liquid that is caused by scum of oxidation burning loss being precipitated to the bottom of the aluminum liquid at the time point t; the M2 is an increased weight of the aluminum liquid that is caused by scum of the oxidation burning loss being floated on the top surface of the aluminum liquid at the time point t;

calculating a weight of the aluminum liquid in the aluminum-liquid thermal-insulation pool at a time point t−1 based on a height of the aluminum liquid at the time point t−1, an oxide layer thickness at the time point t−1, and an oxidation burning loss mass at the time point t−1, by following an equation as follows:

$$M_{as\text{-}t\text{-}1}=M_a(h_{total}-h(t-1)-H(t-1))-M_3-M_4$$

wherein, the $M_{as\text{-}t\text{-}1}$ is the weight of the aluminum liquid in the aluminum-liquid thermal-insulation pool at the time point of t−1; the h(t−1) is a distance from the measuring surface of the rangefinder to the top surface of the aluminum liquid in the aluminum-liquid thermal-insulation pool at the time point of t−1; the H(t−1) is the oxide layer thickness at the time point of t−1; the M3 is an increased weight of the aluminum liquid that is caused by scum of the oxidation burning loss being precipitated to the bottom of the aluminum liquid at the time point t−1; and the M4 is an increased weight of the aluminum liquid that is caused by scum of the oxidation burning loss being floated on the top surface of the aluminum liquid at the time point t−1;

calculating the actual melting speed of the burner at the time point t based on a difference between the weight of the aluminum liquid in the aluminum-liquid thermal-insulation pool at the time point t and the weight of the aluminum liquid in the aluminum-liquid thermal-insulation pool at the time point t−1, by following an equation as follows:

$$V_m(t)-(M_{as\text{-}t}-M_{as\text{-}t\text{-}1})\times 3600/\Delta T_1$$

wherein, the Δt1 is the time difference between the time point t and the time point t−1.

3. The method according to claim 1, wherein, the operation of determining the actual melting speed of the burner, further comprises:

wherein when a portion of the aluminum liquid is taken out of the thermal-insulation pool between the time point t and the time point t−1, updating the height of the aluminum liquid at the time point t to be a sum of a height of the aluminum liquid sampled at the time point t and a reduced height of the aluminum liquid in the thermal-insulation pool;

calculating a difference between the height of the aluminum liquid collected at the time point t and the height of the aluminum liquid collected at the time point t−1; setting a height difference threshold;

if the difference between the height of the aluminum liquid at the time point t and the height of the aluminum liquid at the time point t−1 is greater than the height difference threshold, determining that an abrupt change occurs between a melting speed at the time point t and a melting speed at the time point t−1, and updating the height of the aluminum liquid at the time point t to be a difference between the height of the aluminum liquid collected at the time point t and a height of the aluminum liquid corresponding to the abrupt change in the melting speed; wherein, the height of the aluminum liquid corresponding to the abrupt change in the melting speed is a difference between the height difference of the aluminum liquid corresponding to the time point t and the time point t−1, and the height difference threshold.

4. The method according to claim 1, further comprising:

displaying values of the flow rate of the natural gas, the actual melting speed of the burner, and an energy efficiency of melting the aluminum alloy;

wherein, the energy efficiency of melting the aluminum alloy is represented as:

$$\eta_m=(Q_n\times H_n)/(V_m\times H_i)$$

wherein, the $\eta_m$ is the energy efficiency of melting the aluminum alloy, the $Q_n$ is a real-time flow rate of the natural gas, the $H_n$ is a calorific value of the natural gas, the $V_m$ is a real-time melting speed of the aluminum alloy, and the $H_i$ is a theoretical calorific value for melting a unit weight of the aluminum alloy.

5. The method according to claim 1, wherein, the operation of adjusting the flow rate of the natural gas and the air flow rate based on the difference between the actual melting speed of the burner and the target melting speed of the burner, until the actual melting speed of the burner reaches the target melting speed of the burner, comprises:

calculating a change in the flow rate of the natural gas based on a difference between the actual melting speed and the target melting speed of the burner;

calculating a change in the air flow rate based on an air-fuel ratio coefficient and the change in the flow rate of the natural gas;

setting a target value of the flow rate of the natural gas, wherein, the target value of the flow rate of the natural gas is a sum of the initial flow rate of the natural gas and the change in the flow rate of the natural gas;

setting a target value of the air flow rate, wherein, the target value of the air flow rate is a sum of the initial air flow rate and the change in the air flow rate;

calculating an amount of change in an opening extent of the natural-gas flow-rate regulating valve based on a difference between an actual value of the flow rate of the natural gas and the target value of the flow rate of the natural gas; and calculating an amount of a change in a rotational speed of the blower based on a difference between an actual value of the air flow rate and the target value of the air flow rate.

* * * * *